United States Patent [19]

Datta

[11] 3,942,988

[45] Mar. 9, 1976

[54] PHOTOSENSITIVE COMPOSITION CONTAINING A POLYHALOGENATED INITIATOR AND A CUMULENE DYE FORMER

[75] Inventor: Pabitra Datta, Lyndhurst, Ohio

[73] Assignee: Addressograph Multigraph Corporation, Cleveland, Ohio

[22] Filed: May 28, 1974

[21] Appl. No.: 473,773

[52] U.S. Cl. ..... 96/90 R; 96/67; 96/33

[51] Int. Cl.[2] ..... G03C 1/52

[58] Field of Search ..... 96/90 R, 1.5, 67, 33

[56] References Cited

UNITED STATES PATENTS

| | | | |
|---|---|---|---|
| 3,510,304 | 5/1970 | Fichter et al. | 96/90 R |
| 3,674,473 | 7/1972 | Blanchette | 96/1.5 |

OTHER PUBLICATIONS

Patai: Chemistry of Alkenes, Wiley Interscience Company, 1964, pp. 1088–1098.

*Primary Examiner*—Won H. Louie, Jr.
*Attorney, Agent, or Firm*—Mason, Kolehmainen, Rathburn & Wyss

[57] ABSTRACT

A photosensitive composition useful in providing a positive or negative presensitized coating on a hydrophilic substrate in photosensitive reproduction comprises 1. a cumulene compound having the general formula:

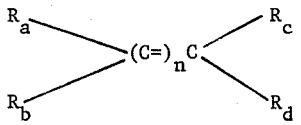

where $n$= 1–6 and $R_a$, $R_b$, $R_c$ and $R_d$ are selected from the group consisting of

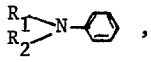

or H and wherein $R_1$ and $R_2$ are the same or different alkyl or aryl radical and each

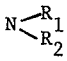

group can be positioned at any other position on the benezene ring, such as

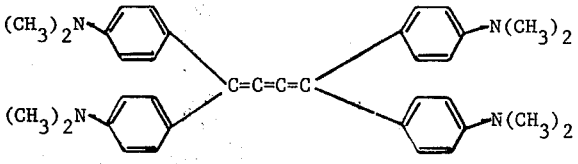

2. an organic polyhalogenated initiator solid at room temperature such as $CBr_4$, and $CHI_3$; and 3. one or more solvents suitable to dissolve the cumulene compound and the organic polyhalogenated initiator such as $CHI_3$. The composition has both positive and negative capability in that after selected exposure to actinic radiation, a polar solvent will dissolve and remove the radiation exposed portion of the composition and a non-polar solvent will dissolve and remove the radiation non-exposed portion.

4 Claims, No Drawings

PHOTOSENSITIVE COMPOSITION CONTAINING A POLYHALOGENATED INITIATOR AND A CUMULENE DYE FORMER

This invention relates to organic photosensitive compositions useful in the preparation of presensitized lithographic plates and useful in other forms of photosensitive reproduction such as in the preparation of microfilm or microfiche. More particularly, this invention relates to a photosensitive composition containing an amino substituted cumulene sensitizer, an organic polyhalogenated initiator, and optionally a polymeric binder, and the method of reproducing copies using the composition.

BACKGROUND OF THE INVENTION

A lithographic master is prepared by coating a flexible metal plate with a light-sensitive composition. A stencil bearing the desired graphic intelligence is then locked over the coated plate in a vacuum printing frame to ensure perfect contact between stencil and plate. The image is then "burned in" as with actinic radiation which shines down through the stencil to the plate, hardening the composition where irradiated and rendering it insoluble in water. Nonprinting areas, which are shielded by the opaque parts of the stencil, are not affected by the action of the light and remain soluble.

After exposure, which varies in length of time according to the nature of the work to be printed, the stencil and plate are removed from the printing frame and separated, the face of the plate is coated with ink, and the plate is then washed. The ink adheres to and brings out the printing image but washes away from the nonprinting areas, carrying the composition with it and leaving the metal exposed. The printing image is then fixed, and subject to final change or correction, the plate is ready for the press.

SUMMARY OF THE INVENTION

The organic photosensitive compositions of the present invention can be used as the photosensitive coating on flexible metal in preparing lithographic plates, as described above. The photosensitive composition described herein can also be used in the preparation of microfilm or microfiche by using the compositions to coat a flexible transparent or translucent sheet such as polyethylene terephthalate or cellulose acetate. In either case, the composition is useful in making both positive and negative reproduction systems.

One object of the present invention is to provide a photochemical reproduction method utilizing a light-sensitive material capable of selected removal after exposure to actinic radiation.

Another object of the present invention is to provide a composition useful in photochemical reproduction wherein the radiation sensitive material has solubility properties modifiable by different solvents so as to provide either a positive or a negative working layer.

Another object of the present invention is to provide a pre-sensitized lithographic plate with positive and negative capability.

Another object of the present invention is to provide a composition useful as a photosensitive layer in which either a radiation exposed or non-exposed portion of the layer can be removed — the choices being dependent upon the selection of solvent used for removal.

Another object of the present invention is to provide a new and improved photochemical reproduction method capable of reproducing any given intelligence onto a flexible hydrophilic substrate.

Another object of the present invention is to provide a composition useful in photochemical reproduction having a photosensitive material wherein the solubility of the material in various solvents can be modified by exposure to actinic radiation.

Another object of the present invention is to provide a composition useful in photochemical reproduction in which the resulting reproduction image density can be further amplified by reacting at least one component of the photochemical composition with a dye.

A further object of the present invention is to increase the image density achieved in photochemical reproduction by reacting at least one component of a photochemical composition with a dye to selectively adhere the dye to the image area.

A further object of the present invention is to provide a photochemical composition having a radiation sensitive material which is stable to oxidation under normal room and storage conditions.

Another object of the present invention is to provide a radiation sensitive material in a photochemical composition wherein the sensitive material has the capability of photochemical reaction to produce a strong color-polar compound.

Another object of the present invention is to provide a photosensitive composition having a binder capable of reaction with an acidic or basic dye to achieve strong dense reproduction of any desired image.

BRIEF DESCRIPTION OF THE INVENTION

In brief, the above and other objects and advantages of the present invention are achieved by providing a new and improved composition useful in photochemical reproduction. The photochemical composition includes a radiation sensitive material and an organic polyhalogenated initiator. The composition can also contain one or more polymeric binders. When the photochemical composition is coated onto a hydrophilic substrate and the thus coated material selectively exposed to actinic radiation, the exposed portion of the coating can be removed by contacting the material with a polar solvent to provide a positive reproduction system. In the alternative, by contacting the radiation exposed coating layer with a non-polar solvent, the unexposed area can be removed to provide a negative reproduction system.

The ability of the photosensitive material to undergo rapid decomposition when exposed to actinic radiation is referred to in the art as "printing speed". Printing speed is a most important property pertinent to its function as a reproduction medium. The property of greater printing speed is manifest when exposed to ultra-violet as well as visible light. In the practice of this invention, rapid decomposition of the photosensitive coating can be accomplished by exposure to actinic radiation through either a translucent or transparent original.

When irradiated with a pattern of radiation (visible or ultra-violet), the photosensitive composition undergoes free radical chain reaction to form a black image corresponding to the pattern of radiation, and at the same time the solubility of the exposed area is modified. These changes are believed to occur in accordance with the following proposed reactions:

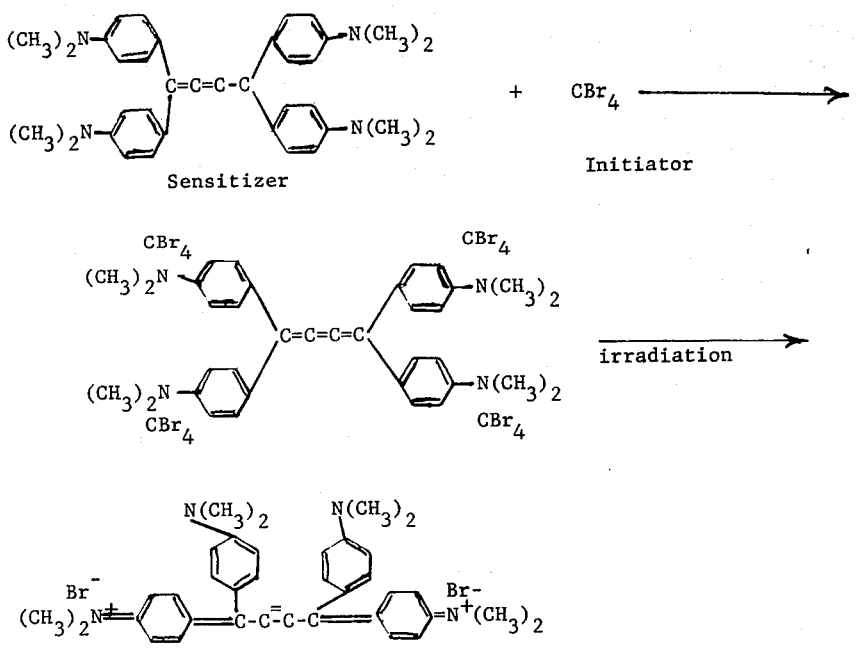

The exposed area becomes soluble in the polar solvents whereas the unexposed areas are soluble in non-polar solvents. Thus, this composition provides either a positive or a negative copy depending upon the development with either polar or non-polar solvents. Further amplification of the image density can be achieved by reacting the basic or acidic functional groups of the binders present in the composition with acidic or basic dyes respectively. This reaction forms salts with the binders which selectively adhere to the image area.

Radiation-Sensitive Materials

The following radiation-sensitive materials when combined with an organic polyhalogenated initiator provide a photochemical composition with its solubility differentially modified by selected solvents. The radiation-sensitive materials include the following:

1. Tetra-substituted amino-phenyl-butatriene with the following general formula:

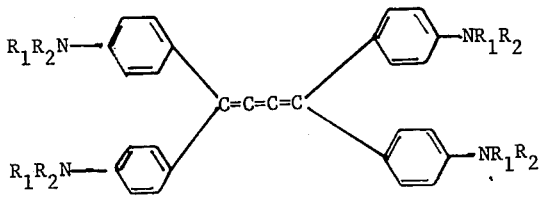

where $R_1$ and $R_2$ (the same or different) are alkyl or aryl and the $NR_1R_2$ group can be any other position on the benzene ring. Preferred alkyl radicals are those having 1–4 carbon atoms and preferred aryl radicals are phenyl, tolyl and xylol.

Examples of specific compounds are the following:

i. Tetrakis-(p-dimethylaminophenyl)-butatriene, wherein $R_1$ and $R_2$ in the above general formula are methyl.

ii. Tetrakis-(p-diethylaminophenyl)-butatriene, wherein $R_1$ and $R_2$ are ethyl.

iii. Tetrakis-(p-diphenylaminophenyl)-butatriene, wherein $R_1$ and $R_2$ are phenyl.

iv. Tetrakis-(p-phenylmethylaminophenyl)-butatriene, wherein $R_1$ is phenyl and $R_2$ is methyl.

The above butatriene compounds are synthesized in accordance with the procedures outlined in *Chemistry of Alkenes*, by Sol Patai, Wiley Interscience Company, 1964, and reference therein footnoted. See also U.S. Pat. No. 3,674,473. In the Patai text, at pages 1088–1098, the synthesis is described. By using the appropriate carbonyl compound in the synthesis, the above butatriene compounds are made. More specifically, the following carbonyl compounds (ketones) are utilized in accordance with the reactions set forth on page 1089 of the Patai text:

i. Di-p-dimethylaminophenyl ketone to produce: tetrakis-(p-dimethylaminophenyl)-butatriene;

ii. Di-p-diethylaminophenyl ketone to produce: tetrakis-(p-dimethylaminophenyl)-butatriene;

iii. Di-p-diphenylaminophenyl ketone to produce: tetrakis-(p-diphenylaminophenyl)-butatriene;

iv. Di-p-phenylmethylaminophenyl ketone to produce: tetrakis-(p-diphenylaminophenyl)-butatriene.

The above carbonyl compounds are known.

2. Di-substituted and tri-substituted aminophenyl butatriene compounds having the following general formula:

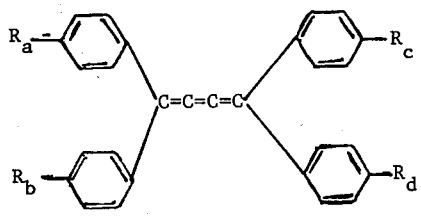

Where one or two of $R_a$, $R_b$, $R_c$ and $R_d$ are each

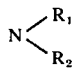

and the remainder of $R_a$, $R_b$, $R_c$ and $R_d$ are H; $R_1$ and $R_2$ (same or different) are alkyl or aryl and each of $R_a$, $R_b$, $R_c$ and $R_d$ can be any other position on the benzene ring. Specific examples of such di- and tri-substituted compounds useful in the practice of this invention are as follows:

i. Bis-1, 4-(p-dimethylaminophenyl)-1, 4-diphenylbutatriene, wherein $R_a$ and $R_c$ are dimethylamino and $R_b$ and $R_d$ are hydrogen.

ii. Bis-1, 4-(p-diphenylaminophenyl)-1, 4-diphenylbutatriene, wherein $R_a$ and $R_c$ are diphenylamino and $R_b$ and $R_d$ are hydrogen.

iii. Bis-1, 4 (p-phenylmethylaminophenyl)-1, 4-diphenyl-butatriene, wherein $R_a$ and $R_c$ and phenylmethylamino and $R_b$ and $R_d$ are hydrogen.

The synthesis of cumulenes is described in the Patai text, chapter 13, pages 1025–1159 and is incorporated herein by reference.

Specific examples of cumulene compounds where R is an amino aromatic radical or substituted amino aromatic include the compounds where R is dimethylaminophenyl, diethylaminophenyl, phenylmethylaminophenyl, and diphenylaminophenyl and *n* is 1 to 6. Preferred among these compounds are tetrakis-(p-dimethylaminophenyl)-ethylene, tetrakis-(p-methylaminophenyl)-pentatetraene, tetrakis-(p-dimethylaminophenyl)-butatriene, and tetrakis-(p-dimethylaminophenyl)-hexapentaene.

4. Also effective are bisbutatriene compounds having the following general formula:

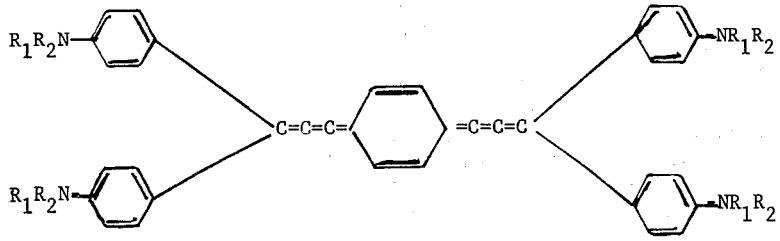

The di- and tri-substituted butatrienes are also synthesized in accordance with the reactions set forth in page 1089 of the Patai text. The following carbonyl compounds are utilized in accordance with the reactions set forth at page 1089:

i. p-Dimethylaminophenyl phenyl ketone for the production of bis-1, 4-(p-dimethylaminophenyl)-1, 4-diphenyl butatriene;

ii. p-Diphenylaminophenyl phenyl ketone for the production of bis-1, 4-(p-diphenylaminophenyl)-1, 4-diphenyl butatriene;

iii. p-Phenylmethylaminophenyl phenyl ketone for the production of bis-1, 4-(p-phenylmethylaminophenyl)-1, 4-diphenyl butatriene;

3. Cumulene derivatives having the general formula:

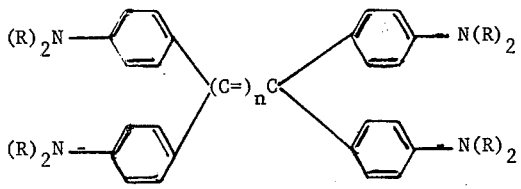

in which $R_1$ and $R_2$ (same or different) are methyl, ethyl or phenyl. A preferred compound is 1,4-bis-[1,1-di-(p-dimethylaminophenyl)]-benzene in which $R_1$ and $R_2$ are methyl.

The synthesis of the above-described bisbutatriene compounds is also set forth in the Patai text in accordance with the equations set forth at page 1093 et. seq. by utilizing the appropriate bifunctional carbonyl compound in the synthesis. More specifically, the aminophenyl ketones described above are utilized in accordance with the reactions set forth at page 1093 of the Patai text. In this way 4,4′-bis(p-dimethylamino)-benzophenone is reacted with lithium acetylide in anhydrous benzene to form bis-(p-dimethylaminophenyl)-ethynylcarbinol which is then converted to the lithium acetylide derivative and reacted with teraphthalaldehyde to produce

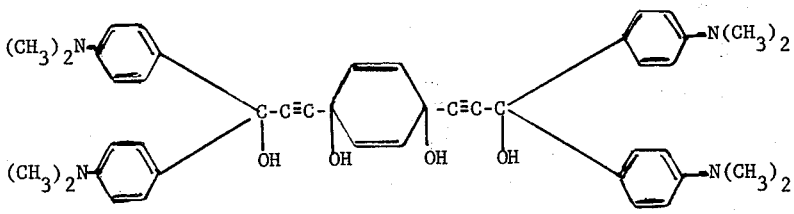

This compound is reduced with stannous chloride in hydrochloric acid to form the cumulene derivative of the general formula given above in which $R_1$ and $R_2$ are methyl. By the same procedure in which quinone is substituted for teraphthalaldehyde there is formed

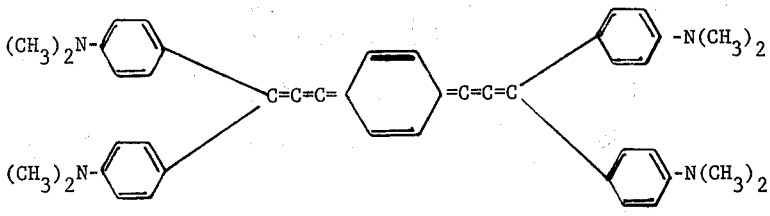

5. Another type of compound effective as the radiation-sensitive material in the composition of this invention is a 1,4-butynediol derivative having the general formula:

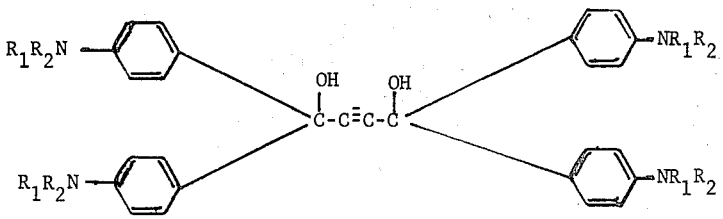

wherein $R_1$ and $R_2$ (same or different) are alkyl or aryl and each

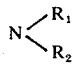

group can be any other position on the benzene ring.

A preferred example of such a butynediol derivative is 1,1,4,4,-tetrakis-(p-dimethylaminophenyl)-2-butyn-1,4-diol, in which $R_1$ and $R_2$ in the preceding formula are methyl.

The above 1,4-butynediol derivatives are synthesized in accordance with the equations set forth at page 1089 of the Patai text by utilizing the appropriate carbonyl compound. For example, to synthesize 1,1,4,4-tetrakis-(p-dimethylaminophenyl)-2-butyne-1,4-diol one starts with 4,4′-bis-(p-dimethylamino)-benzophenone.

Initiators

1. Polyhalogenated compounds solid at room temperature — such as $CBr_4$, $CHI_3$, $CH_2I_2$, $CI_4$, $CHBr_3$, $CBr_3CH_2OH$, $C_6Br_6$, $CBr_3$-$CO_2H$ or similar compounds with any other halogen so long as the compound is solid at room temperature.
2. Polyhalogenated ketones solid at room temperature such as trihalogenated (eg. tribromo) acetophenone and their derivatives: $C_6H_5$—CO—$CBr_3$ where Br can be substituted by any other halogen so long as the compound is solid at room temperature.
3. Polyhalogenated sulfoxides solid at room temperature:

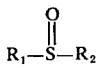

where $R_1$=$CX_3$, phenyl, or substituted phenyl
$R_2$=$CX_3$ where X is a halogen An example of a specific sulfoxide useful in the practice of this invention is:

(i) $R_1$=$R_2$=$CX_3$, X=Br hexabromodimethyl sulfoxide:

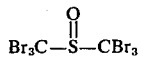

4. Polyhalogenated sulfones solid at room temperature

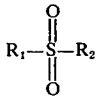

where $R_1$=$CX_3$, phenyl, or substituted phenyl
$R_2$=$CX_3$ where X is a halogen Examples of specific polyhalogenated sulfones are as follows:

(i) $R_1 = R_2 = CX_3$, X – Br;

Hexabromodimethyl sulfone (ii) $R_1$ = phenyl, $R_2 = CX_3$, X = Br;

Phenyl tribromomethyl sulfone (iii) $R_1$ = p-nitrophenyl, $R_2 = CX_3$, X = Br;

p-nitrophenyl tribromomethyl sulfone

Binders (Optional)

Various binders may be used, if desired, with these photosensitive materials. The most useful binders include film-forming resins having active basic or acidic functional groups. These functional groups can interact with the photosensitive materials and react with acid or basic dyes, forming salts which selectively adhere to the image area and thereby increase the image density.

The best binders tested are novolak resins with maleic, fumaric, or phenolic groups; polyvinylpyridine; polyvinylformal, maleic, and vinyl ether copolymers. Specific examples of suitable binders are as follows: phenolformaldehyde resins; polyvinylpyridine resins, polyvinylformal resin, polycarbonate resin, polymethyl methacrylate resin, and epoxy resins.

The radiation-sensitive material and the organic polyhalogenated initiator are added to a suitable solvent each in approximately the same amount of about 0.1% to 10.0% by weight based on the total weight of the composition. The preferred range for both the radiation-sensitive material and the initiator is 0.4% to 0.6% by weight of the total solution. There are a wide range of solvents useful in dissolving the sensitizer and initiator in preparing the solution. Some of the solvents found to work quite well are chlorinated materials such as carbon tetrachloride, methylene chloride, and chloroform.

A second solution containing a binder can optionally be prepared by adding about 3% to 10% by weight of binder solids to a suitable solvent for the polymeric binder. The preferred percentage range for binder solids is 4% to 6% by weight. The binder solution is then added to the sensitizer-initiator solution by adding approximately one part by weight of binder solution to four parts by weight of sensitizer-initiator solution.

The sensitizer and binder solution are each prepared separately simply for convenience. When a binder is optionally desired, as when increased image density is needed, the binder solution can be readily mixed with the sensitizer solution. Of course, the solution could be prepared as one mixture.

Any hydrophilic substrate can be used such as treated aluminum, zinc, zinc oxide in binder(s), titanium dioxide in binder(s), and clay coated paper masters. To prepare the lithographic master of the instant invention, coating solution is applied in an amount of about 5 to 15 grams per square meter of surface area, preferably 8 to 12 grams per square meter.

Positive (Polar) and Negative (Non-Polar) Solvents

By selecting a proper solvent, either a positive or negative working system can be provided. The solvent is used to treat the coated hydrophilic substrate to selectively remove either the radiation exposed (positive) or non-exposed (negative) portion of the coating.

When a coated plate is selectively exposed to actinic radiation the resulting reaction between the radiation sensitive material, the initiator, and optionally the binder causes the coating to become polar in the exposed area. The exposed polar material is then soluble in polar solvents to provide a positive system and the unexposed non-polar material soluble in non-polar solvents to provide a negative system.

Some of the useful polar solvents are lower alcohols such as methanol, ethanol, propanol and isopropanol; ketones such as acetone, MEK, diethyl ketone and methypropyl ketone; lower alcohols or ketones mixed with water; glycols; glycerine; and a mixture of ammonium phosphate and formaldehyde in water.

Some of the useful non-polar solvents are benzene; carbon tetrachloride and mixtures thereof in chlorinated benzene; non-polar ketones; and Stoddard solvent.

EXAMPLE 1

The sensitizer solution is prepared by adding 0.1 gram tetrakis-(p-dimethylaminophenyl)-butatriene sensitizing material and 0.1 gram carbon tetrachloride initiator to 20 grams of chloroform solvent. A binder solution is prepared by adding 0.25 gram of poly-2-vinylpyridine binder to 4.25 grams of chloroform solvent.

The sensitizer and binder solutions are filtered through glass wool and then mixed immediately with a magnetic stirrer. This composition is then coated on a polyethylene terephthalate film in the amount of about 10 grams per square meter.

Then, the photosensitive film is exposed through a photographic negative stencil to a Sylvania sun lamp at 2½ feet from the plane of the photosensitive film. An image was observed within 5 sec. and a good image was observed after 30 sec. of exposure. Then, the exposed film is developed with benzene. A good black image is observed.

Another coated film is exposed through a photographic positive stencil to a Sylvania sun lamp for 1 minute and then developed with a 75% methanol, 25% water solution. A good red positive image appeared.

EXAMPLE 2

The sensitizer solution is prepared by adding 0.1 gram tetrakis-(p-dimethylaminophenyl)-butatriene sensitizer and 0.1 gram carbon tetrabromide initiator to a mixture of 10 grams of chloroform and 10 grams of methyl ethyl ketone (MEK). A binder solution is prepared by adding 0.25 gram of copolymer of maleic anhydride and methyl vinyl ether in 4.75 grams of MEK.

The sensitizer and binder solutions are filtered through glass wool and then mixed immediately with a magnetic stirrer using one part by weight binder solution to four parts by weight sensitizer solution. This composition was coated on a polyethylene terephthalate film in the amount of about 10 grams per square meter and dried.

Then a photosensitive plate is exposed through a photographic negative stencil to a Sylvania sun lamp at 2½ feet from the plane of the photosensitive film. An image was observed within 5 sec. and a good image was observed after 30 sec. of exposure. The exposed film then is developed by contact with benzene. A good positive black image is observed. The density of this image is further improved by dipping into a 5% solution of methylene blue dye.

Another coated film is exposed through a photographic positive stencil to a Sylvania sun lamp for 1 minute. It then is developed with a solution of 75% methanol, 25% water. A good red positive image is observed. The density of the red image is improved by treatment with a basic dye solution.

EXAMPLE 3

The light sensitive plate of this example is prepared following the procedure of Example 1, with the exception that the mixed sensitizers and binder solutions are coated on an aluminum plate whose surface has been treated to render it hydrophilic.

The aluminum photosensitive plate is exposed in the same manner as the film in Example 1, that is, as a positive plate using a photographic negative. In addition to development with benzene, the metal plate is cleaned with an abrasive and then treated with a conventional lithographic lacquer such as sold by Minnesota Mining and Manufacturing Corporation to produce the oleophilic image. The printing plate of this example produced more than 10,000 lithographic reproductions on a conventional lithographic duplicator.

EXAMPLE 4

The light sensitive plate of this example is prepared following the procedure of Example 3 with the exception that a positive photographic transparent film is used in place of the negative. Exposure to the Sylvania sun lamp is carried on for about one minute. A 75% methanol in water solution is used in place of benzene to produce the image. A red colored positive image was observed. The plate is then cleaned with an abrasive and has applied to it a lithographic lacquer similar to the step described in Example 3. The lithographic plates of this example were observed to produce 10 to 15 thousand good lithographic reproductions using a conventional lithographic duplicator.

What is new and desired to be secured by Letters Patent in the United States is:

1. A composition of matter useful in photochemical reproduction comprising a cumulene compound having the general formula:

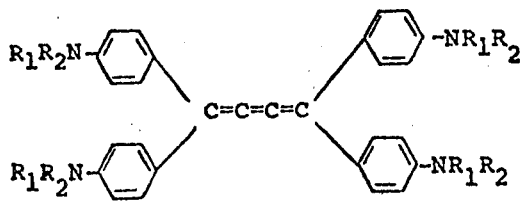

where $R_1$ and $R_2$ are the same or different alkyl or aryl radical and each

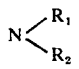

group can be positioned at any other carbon on the benzene ring;

an organic polyhalogenated initiator solid at room temperature and is capable of promoting free radical reaction with said cumulene compound upon exposure to light; and one or more solvents suitable to dissolve the cumulene compound and the organic polyhalogenated initiator.

2. A composition of matter useful in photochemical reproduction comprising a cumulene compound having the general formula:

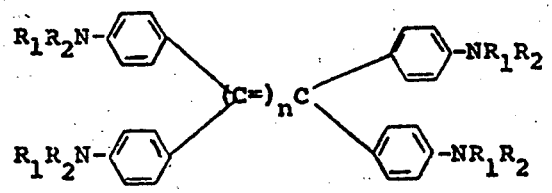

wherein $n$= 1–6; and $R_1$ and $R_2$ are the same or different alkyl or aryl radical;

an organic polyhalogenated initiator solid at room temperature and is capable of promoting free radical reaction with said cumulene compound upon exposure to light; which one or more solvents suitable to dissolve the cumulene compound and the organic polyhalogenated initiator.

3. A composition useful in photochemical reproduction comprising:

a bisbutatriene compound having the general formula:

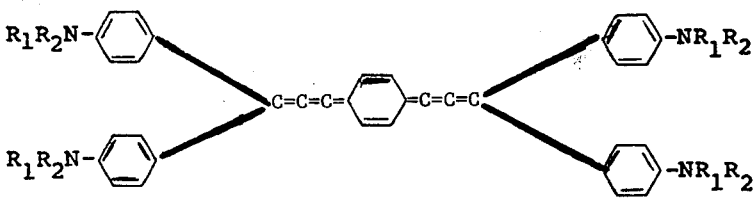

in which $R_1$ and $R_2$ are methyl, ethyl or phenyl;

an organic polyhalogenated initiator solid at room temperature and is capable of promoting free radical reaction with said cumulene compound upon exposure to light; and one or more solvents suitable to dissolve the bisbutatriene compound and the organic polyhalogenated initiator.

4. A composition useful in photochemical reproduction comprising:

a butynediol compound having the general formula:

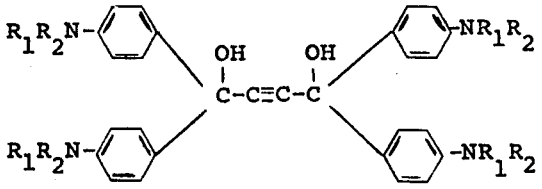

wherein $R_1$ and $R_2$ are the same or different alkyl or aryl radical and each

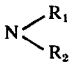

group can be any other position on the benzene ring;

an organic polyhalogenated initiator solid at room temperature and is capable of promoting free radical reaction with said cumulene compound upon exposure to light; and one or more solvents suitable to dissolve the butynediol compound and the organic polyhalogenated initiator.

* * * * *

UNITED STATES PATENT OFFICE

CERTIFICATE OF CORRECTION

Patent No. 3,942,988 Dated March 30, 1976

Inventor(s) Pabitra Datta

It is certified that error appears in the above-identified patent and that said Letters Patent are hereby corrected as shown below:

Claim 1, column 11, 4th line from the formula, change "and" to --which--.

Claim 2, column 11, 4th line from the formula, change "and" to --which--.

Claim 2, column 11, 6th line from the formula, change "which" to --and--.

Claim 3, column 12, line 3, change "and" to --which--.

Claim 4, column 12, 3rd line from second formula, change "and" to --which--.

Signed and Sealed this eighth Day of June 1976

[SEAL]

Attest:

RUTH C. MASON
Attesting Officer

C. MARSHALL DANN
Commissioner of Patents and Trademarks